US006467867B1

(12) United States Patent
Worthington et al.

(10) Patent No.: US 6,467,867 B1
(45) Date of Patent: Oct. 22, 2002

(54) METHOD AND APPARATUS FOR REGISTRATION AND COLOR FIDELITY CONTROL IN A MULTIHEAD DIGITAL COLOR PRINT ENGINE

(75) Inventors: John Walter Worthington, Minnetonka; Lawrence J. Lukis, Long Lake, both of MN (US)

(73) Assignee: MacDermid Acumen, Inc., Waterbury, CT (US)

( * ) Notice: Subject to any disclaimer, the term of this patent is extended or adjusted under 35 U.S.C. 154(b) by 0 days.

(21) Appl. No.: 08/922,297

(22) Filed: Sep. 3, 1997

(51) Int. Cl.[7] ..... B41J 29/393
(52) U.S. Cl. ..... 347/19
(58) Field of Search ..... 347/19, 116, 9, 347/115; 250/200; 358/504, 406

(56) References Cited

U.S. PATENT DOCUMENTS 4,878,063 A * 10/1989 Katerberg ..... 347/19
4,990,932 A * 2/1991 Houston ..... 347/19
5,276,459 A * 1/1994 Danzuka et al. ..... 347/19
5,363,134 A * 11/1994 Barbehenn et al. ..... 347/19

* cited by examiner

*Primary Examiner*—John E. Barlow
*Assistant Examiner*—Charles W. Stewart, Jr.
(74) *Attorney, Agent, or Firm*—Carmody & Torrance LLP

(57) ABSTRACT

The present invention relates to a method and apparatus for precise placement of discrete marks comprising a digital image using an optical sensor adapted to read individual dots of a variety of calibration patterns. The sensor is preferably coupled to a reciprocating carriage assembly so that the dot patterns recorded upon a printing media from at least two of a plurality of print heads disposed on the carriage assembly are compared, a preferred timing or trajectory control sequence is calculated, and thereafter relayed to the print heads to correct for physical misalignment of print heads, manufacturing tolerance errors, and the like to improve registration in a digital color print engine.

9 Claims, 11 Drawing Sheets

METHOD AND APPARATUS FOR REGISTRATION AND COLOR FIDELITY CONTROL IN A MULTIHEAD DIGITAL COLOR PRINT ENGINE

FIELD OF THE INVENTION

The present invention relates generally to the field of non-impact printing and, in particular, the present invention reveals a method and apparatus for improving both color fidelity and registration among several non-impact print heads operating in a digital color print engine.

BACKGROUND OF THE INVENTION

In the prior art related to ink jet printing a print head operated under precise electronic control typically opposes a portion of a printing media so that an image may be printed thereon. Typically, to achieve printed images of the highest quality each of a plurality of ink emitting elements that emit droplets of colorant onto the printing media need synchronization in respect of their position and orientation with respect to each other such element (i.e., exact "registration"). In prior art multihead digital print engines including drum-based, swath (or carriage-based), and flat-bed digital print engines, it is known that consistency of mounting and operation of such elements increases the level of registration among said elements and thus decreases the likelihood of printing errors and image artifacts. In a traditional drum-based print engine a print media attaches to a rotating drum which then passes under one or more discrete ink emitting print elements ("nozzles") mounted on a carriage articulated in the axial direction. In a flat bed print engine, the printing media is rigidly coupled to a substantially planar surface and the nozzles are articulated in two dimensions to cover the media. In a reciprocating swath, or carriage-based, print engine the media is incrementally stepped over a platen surface in one direction while the nozzles reciprocate across the media in a direction orthogonal to direction the media advances. In many of these traditional print engines perfect registration has become even more difficult to efficiently achieve as the number of print heads and the number of ink emitting elements increase and service and replacement procedures become more frequent. In each of these types of prior art print engine mechanisms, registration among and between nozzles of print cartridges may always be improved since no known means yet exists to rapidly, and perfectly, register each element to every other ink emitting element. Accordingly, in practical terms it is known that in some businesses specializing in producing full color digitally printed output, time constraints to complete printing jobs will conflict and oftentimes prevail with time required to complete full calibration and registration routines.

Furthermore, due to imperfection and general variation introduced during manufacture of print head elements, and their associated mounting elements, a number of electrical and mechanical variables that impede extremely accurate dot placement in an ink jet print engine thus compounds the difficulty in achieving perfect registration among all print heads at all times during printing operations. Particularly with reference to disposable ink jet print cartridges, "cartridges" or "print heads" herein, variations among cartridges are even further compounded as a result of periodic removal, substitution, cleaning, and/or replacement of a given one or more of several cartridges where misalignment error(s) regularly occur from inexact replacement following removal.

In these and other printing processes output is created by a plurality of multi-hued ink droplets emitted under precise electronic control in sequence from ink emitting nozzles of cartridges. Such ink droplets must record (a "dot") as close as possible to exact pre-selected locations on the printing media to accurately reproduce printed output of an original source image with color fidelity and graphic quality corresponding to the original image. Unfortunately, due to a number of underlying causes, including compromises between time and quality in volume image production environments, said droplets often record dots upon the printing media at imprecise locations and thus generally degrade image quality and color fidelity of the printed image. As noted above, a primary cause involves a simple and oftentimes misalignment of one or more of the print heads (and thus the ink emitting nozzles associated with said print heads). In print engines that utilize disposable or removable print heads such slight misalignment potentially occurs every time one or more print heads is replaced or removed during periodic manual cleaning and other service of said print heads. Other causes of misregistration include differing ink droplet volume, varying ink droplet velocities of droplets emitted from different nozzles of a print head, bi-directional printing, slight non-alignment of the print heads, differing thickness of the printing media, and differing electrical characteristics of individual ink emitting nozzles and/or cartridges, among others.

Thus, it is known and can be appreciated that electrical and mechanical tolerance variations introduced during manufacture (and human error in mounting) of said cartridges has long presented, and continues to present, obstacles to extreme visual clarity in high speed digital color drop-on-demand and continuous-type printing. A clear implication of the level of compensation desired in the prior art is to allow for manufacturing tolerances to be relaxed somewhat without degradation in image quality, and thus manufacturing costs can decrease to the degree such tolerances can be relaxed.

Many prior art approaches to improving registration of a plurality of print heads, or compensating for image quality defects involve manual inspection, manual entry of perceived data values into an electronic print engine controller, and manual cleaning operations of each print head, although other varied approaches have been disclosed in the prior art. For example, in U.S. Pat. No. 5,644,344 issued to Haselby Jul. 1, 1997 depicts methods of calibrating and aligning an operation of print head cartridges in a swath printer using a carriage-mounted analog sensor oriented to sense edges of line segments printed by print cartridge print elements and then calculating a linear equation that transforms optical sensor values to adjust swath data shifts and timing delays. This representative prior art approach fails to account for a number of variables in printing that are addressed in the present invention, but otherwise adequately describes the state of the prior art fairly well.

Thus, a need exists in the prior art to solve issues related to the performance limitations of known print engines which emit ink from nozzles onto a print media. Further, a need exists in the art of digital ink jet printing to compensate for minute registration, or dot placement errors, and faulty performance of and among nozzles of print cartridges and to accurately sense and control registration and color image fidelity by sensing individual dots created by colored ink droplets in order to improve the quality and the visual clarity of text, graphics, and color appearing on the print media. Finally, a need exists in the art to improve the yield of quality digital output given practical and mechanical constraints imposed by use of ink emitting print heads mounted at some distance above a printing media as to synchronize and perfect registration among each of a plurality of colored ink droplets so they accurately record dots upon desired locations on the printing media to thus rapidly form high quality printed output closely resembling original source images.

SUMMARY OF THE INVENTION

The method and apparatus of the present invention increases the precision for controlling a plurality of cartridges that emit colored ink droplets from at least two ink jet print cartridges in a digital print engine. The present invention addresses both registration and color fidelity aspects of digital color ink jet print engines by utilizing an optical sensor to sense and accurately locate patterns of individual dots created by droplets emitted from said print cartridges. A focused source of illumination preferably periodically illuminates individual dots on the printing media so that such individual dots can be sensed by an array of optical sensor elements. A series of electronic images are recorded during said periodic illumination and each may be stored, compared to a corresponding series of reference dot patterns, then used for updating an electronic printing sequence, and/or viewed on a monitor to confirm orientation and location of the optical sensor with respect to individual dots. The electronic image is typically temporarily stored as a two dimensional bit map in a portion of a memory storage device that may include location, size, and color information of each individual dot interrogated and successfully detected by the optical sensor. The source of illumination may comprise many different colored source elements, such as red, green, blue (RGB); or cyan, yellow, magenta, black (CMYK); or other; depending on which color space is desired for color correction procedures as is known and used in the art.

The present invention thus finds increased utility over a variety of prior art printing methods and platforms to achieve both accurate placement and registration among a plurality of ink droplets recorded on a variety of desired pre-selected locations of a printing media and to confirm or correct color fidelity of an image. By sensing dot patterns produced by one or more print head cartridges with a first print nozzle control sequence and then determining which of a variety of controlled parameters to adjust to improve registration and color fidelity first among nozzles of each cartridge with respect to each other and thereafter among nozzles of different cartridges. In a preferred embodiment of the present invention, a print engine employs several print heads that can readily provide nozzle redundancy so that mis-firing and non-firing nozzles may be compensated and replaced by fully operational nozzles without degradation of image or needless loss of available printing time. The initial steps of the inventive method herein preferably include conducting compensation calculations based upon the location of discrete dots recorded on the print media, which calculations are promptly implemented in an amended excitation control sequence prior to initiating later calibration steps so that successively finer tuning for dot placement accuracy results.

The present apparatus includes an optical sensor for sensing and storing information about dots recorded on a print media by said print heads wherein the optical sensor is preferably coupled to the carriage assembly, and based upon each of several iterative steps where differing calibration patterns are optically sensed, achieves highly accurate registration among the print heads.

The following figures are not drawn to scale and only detail a few representative embodiments of the present invention, more embodiments and equivalents of the representative embodiments depicted herein are easily ascertainable by persons of skill in the digital imaging arts, and are expressly covered hereby. The inventors reserve the right to augment or otherwise render any portion of the written description, and those aspects inherent therein and known to those of skill in the art, as illustration(s) hereof.

DESCRIPTION OF THE DRAWINGS

FIG. 13 is a perspective view of swath type carriage-based digital print engine showing the carriage, cartridges, perforated platen (including the preferred extra perforations at edges of print media), vacuum source for retaining the media, electronics bay ventilation passages which port heated air from the electronics bay to exhaust ports that promote drying of said media, and the environmental sensor suite for measuring and recording humidity, temperature, acidity, and the like.

DESCRIPTION OF PREFERRED EMBODIMENT

Figure 1:
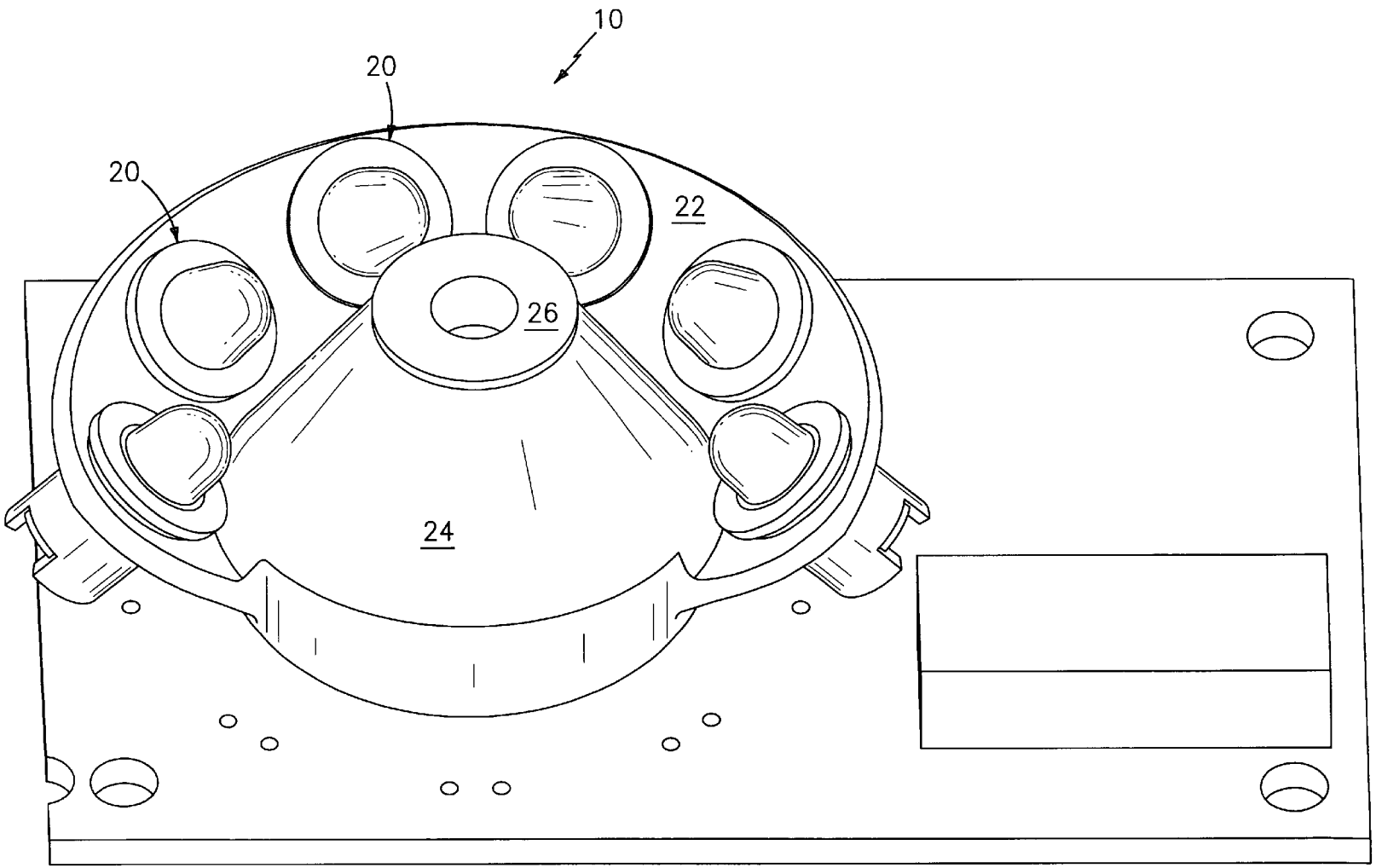
FIG. 1 is a perspective view depicting an optical sensor subassembly of one embodiment of the present invention.

The present invention encompasses an apparatus and iterative method of applying and sensing calibration dot targets to improve a control sequence for a plurality of ink emitting elements operating in a print engine having multiple print heads. As described herein the present invention detects and compensates for failed elements, corrects for misalignment (and a degree of misfiring) of elements, and improves dot placement uniformity, accuracy, and registration in the x-axis (or carriage axis) and y-axis (or media web) directions. When dot placement errors are detected the offending ink emitting nozzle typically either receives a newly-timed compensated excitation signal or is eliminated from further operation (and replaced by an operational nozzle). As introduction, a preferred sequence of practicing the present invention appears directly below and a detailed description of preferred embodiments with reference to the figures herein immediately follows said introductory material.

The preferred calibration pattern sequence involves first applying a solid area of dark colorant and leaving a similarly sized area adjacent media without colorant and then orienting an optical sensor to oppose said area and acquiring "whitepoint" and "blackpoint" output reference signals from said optical sensor to confirm the sensor components are electrically coupled together and calibrates the optical sensor. Next, a preferably cross-shaped homing mark is applied to the media and then acquired by the optical sensor with reference to an x-axis horizontal encoder signal and a y-axis media web signal acquired from media drive components. Then, two identical scaling dot pattern marks of known size and separation dimension are applied to the media and detected by the optical sensor to provide a translation or mapping between an optical sensor space and a printed-dot space so that printed dots can be correlated to pixel elements when detected by the optical sensor. The scaling in the preferred embodiment usually produces eight optical sensor pixels per printed dot thus producing a registration accuracy of approximately ⅛th of a printed dot. Then, a "fingerprint" pattern for each print head is printed upon the media and comprises two fingerprint patterns for each cartridge, wherein each is printed with unidirectional print passes of opposing direction, and one dot is recorded for each nozzle of each print head, all said dots of each fingerprint pattern being recorded in an area covered by the field of view of the optical sensor, and all adjacent dots within each fingerprint pattern having the same spacing from all other adjacent dots so that a single unique correlation is available for each said pattern. All mis-firing, "bent" nozzles and all nozzles having an appreciable droplet velocity variation from an average droplet velocity are identified by comparison of the two sets of fingerprint patterns. A bent nozzle biased in the y-axis direction is easily detectable, and a bent nozzle biased in the x-axis direction can be distinguished from a nozzle having an non-average velocity due to the different dot placement between the two unidirectional printed patterns. The nozzles having velocity error will have a common repeatable error either by exhibiting an advanced or a tardy dot in relation to other dots whereas a bent nozzle will not exhibit similar symmetry. In a practical, preferred mode of the present invention, such bent nozzles are identified and tolerated only to the extent that seriously mis-firing or otherwise faulty nozzles are absent. Then, a bi-directional pattern is printed and analyzed by the optical sensor and any variation in dot placement identified and a corrective excitation sequence generated for use during later printing operations. Then, head-to-head registration patterns are printed upon the media with reference to a single print head and the dot patterns are identified for accuracy and a corrected excitation sequence generated for use during later printing operations. Instead of periphery detection of dots, the inventors have implemented a detection process that utilizes synthesized correlation between "reference" bitmap images and optically-sensed bitmap images in order to create a meaningful spike in the sensor signal for a single, unique correlation when found. As is known in the art, such correlation techniques involve fourier transforms to reduce a relatively intractable pattern matching routine to rapid transformation in a frequency domain space. As a result of these known techniques, the optical sensor does not need to acquire and center an acquired image in its field of view. In the present invention, typically two patterns are printed so that both are present in the field of view of the optical sensor and all dot patterns are relative to a fudicial mark. Preferably, a common specification is used to generate the reference bitmap and the driving signals for creating each of the printed calibration patterns.

During optical sensor operation one or more LEDs preferably produces illumination of desired wavelength to optimize returns from the recorded colorant(s) as is known and used in the art (i.e., blue light promotes response from yellow dots). The source of illumination serves another goal in that sufficient illumination assists in drowning out background sources of illumination which can create anomalous results. Preferably a very small aperture lens is used in focusing the illuminating radiation on the focal plane of the optical sensor to improve depth of field; thus, the brightest, and most accurate illumination sources are preferred in practicing the present invention. In practice a field of view of approximately 60 imaging pixels by 40 imaging pixels is used herein. A larger field of view will allow greater variety of registration procedures clearly covered hereby, whether or not described in detail as to said range or scope of field of view of said optical sensor.

The present invention is first described with reference FIG. 1 which depicts an enlarged perspective view of an optical sensor assembly 10 preferred by the inventors for implementing the invention taught, enabled, and fully disclosed herein. The assembly 10 includes base support member 12 for retaining the assembly 10 to a carriage assembly (not shown). A number of illumination sources 20 are disposed on an annular surface 22 of a basket member 24 and oriented to produce illumination of a printing media opposing lens 26 which focuses the illumination energy onto a sensor array 100 disposed within the basket member 24 which is electrically coupled to memory storage 32, remote print cartridge control electronics 30, and optionally, a viewing monitor device 34 (see FIG. 5 and 13). The sources of illumination 20 are preferably light emitting diodes (LEDs) having precise emission spectral characteristics of known wavelength and intensity.

Figure 2:
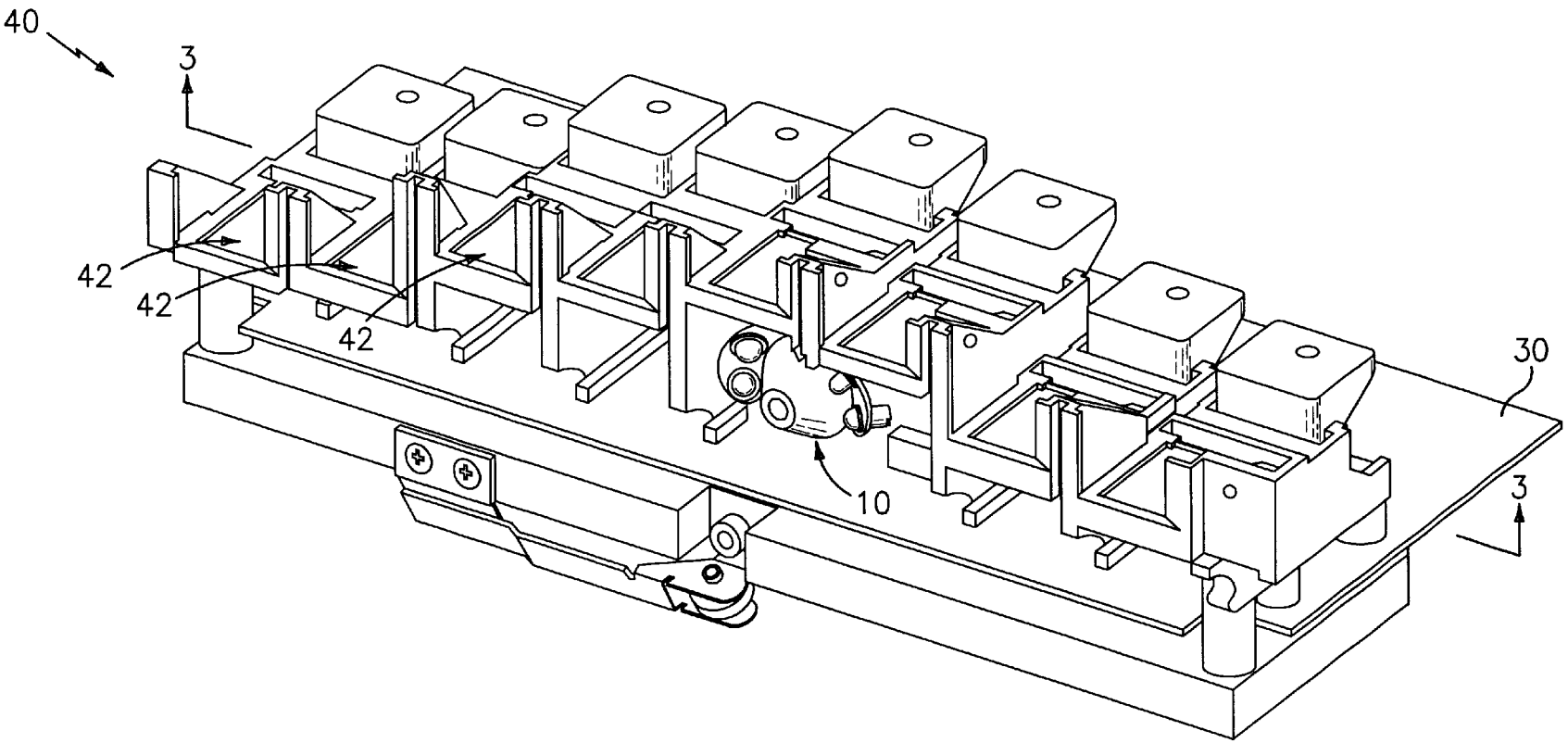
FIG. 2 is a perspective view depicting the optical sensor subassembly of FIG. 1 disposed in a multi-print head carriage assembly.

Referring now to FIG. 2 a perspective view of a preferred carriage assembly 40 illustrating the receptacle 38 for retaining optical sensor assembly 10 and a plurality of stand-off circuit board mounting bosses 44 for connecting the carriage circuit board 30 to the carriage assembly 40. In the depicted embodiment eight receiving sockets 42 for releasably retaining a disposable print head are oriented to minimize the footprint of carriage assembly 40 so that when eight print heads 43 are retained in said sockets 42, an ink coverage area of each said print head 43 doesn't coincide with any other print head 43 in the x-axis direction. Furthermore, the embodiment depicted in FIG. 2 shows a preferred orientation for optical sensor assembly 10, disposed with lens 26 at some arbitrary height above an ink receiving print media 36 (not shown). The sensor assembly is received in receptacle 38 proximate and electrically coupled to a local optical sensor circuit board which in turn couples to circuit board 30 (where 8×32 Kb memory storage is available) which in turn is connected via a serial conduit to a main CPU (and associated memory) located in an electronics bay portion of the print engine.

Figure 3:
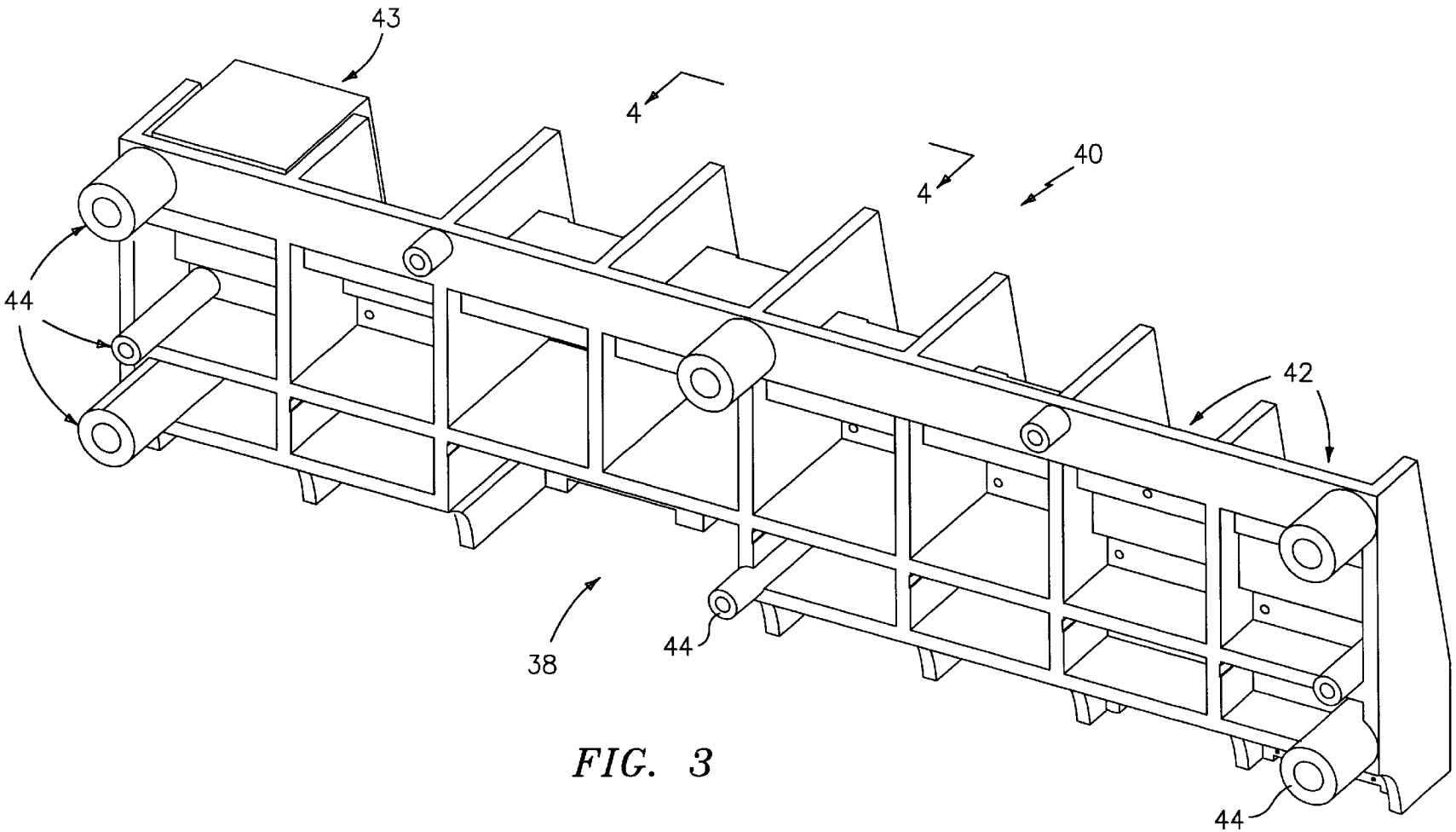
FIG. 3 is a perspective view depicting the carriage assembly of FIG. 2 along the lines 3—3 of FIG. 2 and illustrating the receptacle for retaining an optical sensor and the stand-off circuit board mounting bosses of the carriage assembly.

Referring to FIG. 3, which is a perspective view along line 3—3 of FIG. 2 illustrating the circuit board mounting bosses 44 formed integrally in carriage assembly 40 and the receptacle 38 for receiving and retaining the sensor 100 in proximity to carriage circuit board 30 (not shown). The sockets 42 for print heads 43 are preferably electrically coupled to carriage circuit board 30 via a plurality of traces deposited on flexible circuitry as is known and used in the art, and a similar flexible circuitry connection is used to electrically couple circuit board 30 to the system-level electronics and main CPU stored in the electronics bay.

Figure 4:
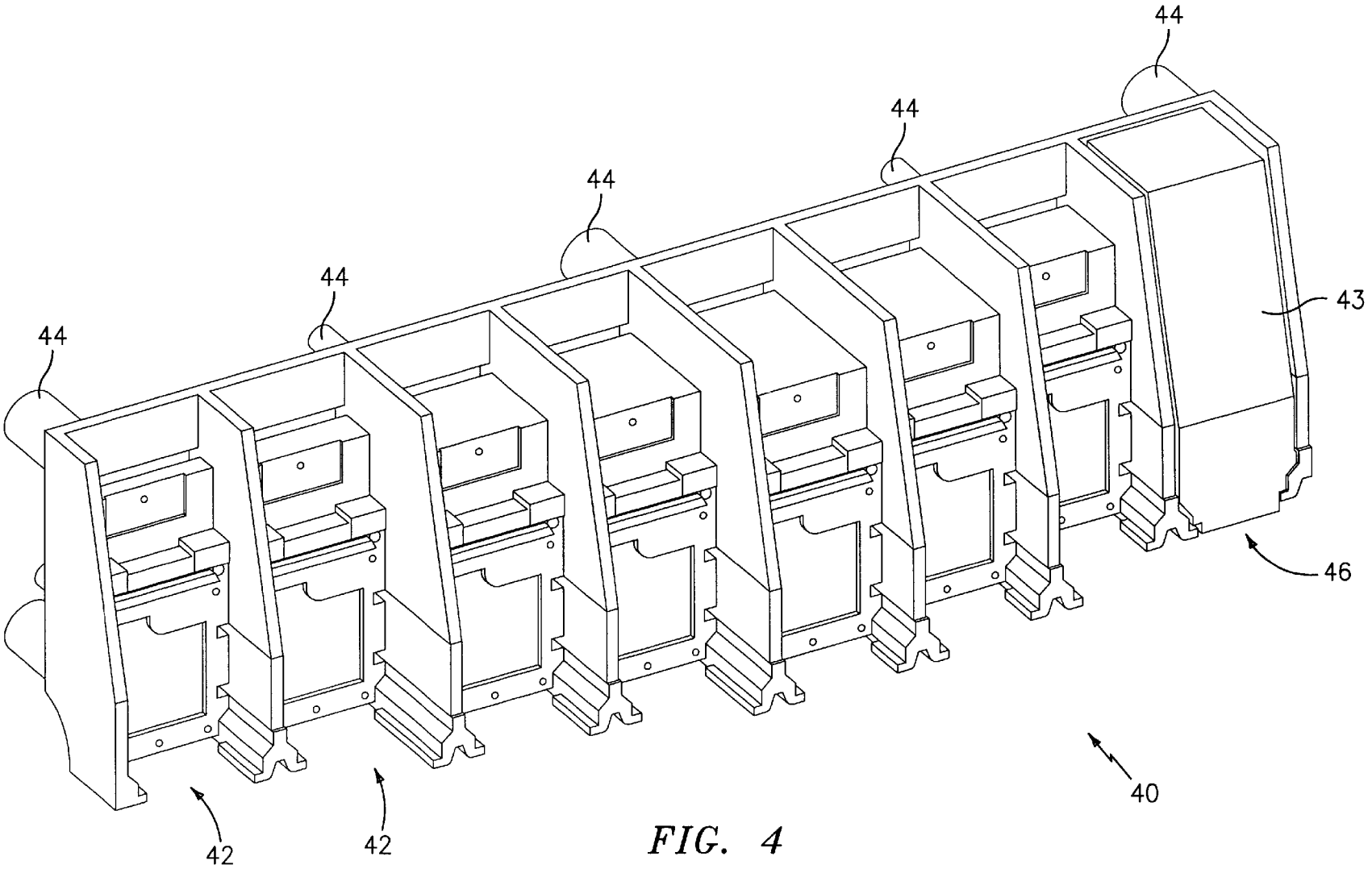
FIG. 4 is a perspective view depicting the carriage assembly of FIG. 3 along the lines 4—4 of FIG. 3 and illustrating the socket receptacles for retaining eight print head cartridges to the carriage assembly.

Referring to FIG. 4, which is a perspective view of the carriage assembly 40 shown along lines 4—4 of FIG. 3, a more detailed illustration of an eight socket 42 used in a preferred form of the present invention is shown. A single cartridges 43 is shown mounted in place in a single socket 42 of carriage 40. While not clearly depicted nozzles 46 disposed on a lower orifice surface emit ink when energized. Preferably the cartridge is supplied by Hewlett-Packard Company, of Palo Alto, Calif., U.S.A. as pen model number 51626 which has two rows of twenty-five nozzles 46 oriented across the surface of an orifice plate as is well known in the art. In order to keep the carriage assembly as lightweight as possible, as much material as possible has been purposely eliminated while preserving the strength and durability of said eight print head carriage assembly 40. Further detail the temporary retaining means present in socket 42 is discussed and depicted in U.S. patent application Ser. No. 08/711,796 titled "Cooperating Mechanical Subassemblies for a Drum-based Print Engine" filed on the Sep. 10, 1996 and incorporated herein by reference.

Figure 5:
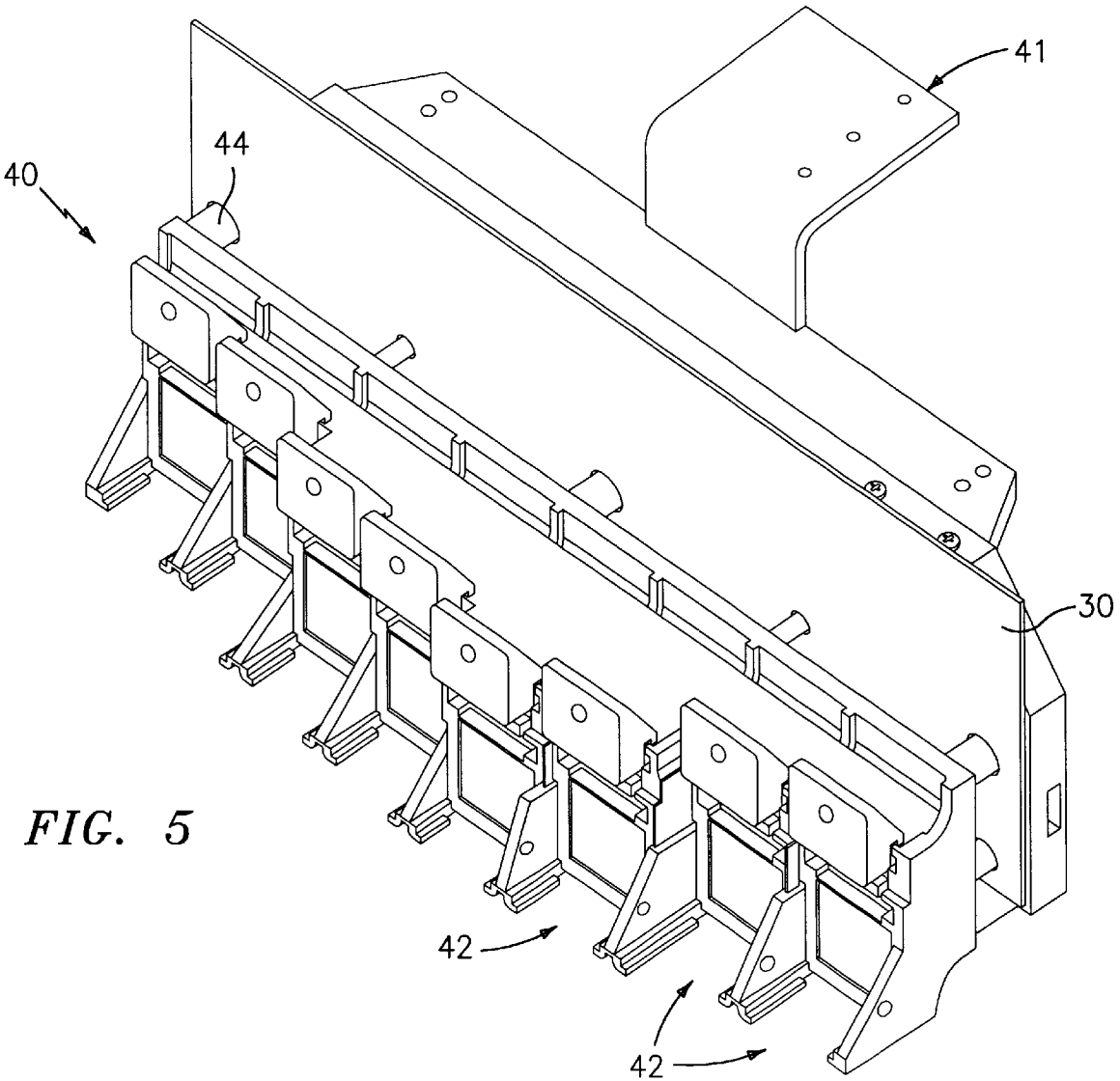
FIG. 5 is a perspective view depicting the carriage assembly and illustrating the print head circuit board mounted on the carriage assembly in contact with several stand-off circuit board mounting bosses thereby spaced in a heat dissipating orientation.

Referring now to FIG. 5, a perspective view of carriage assembly 40 wherein carriage circuit board 30 is shown in place abutting circuit board mounting bosses 44 so as to promote cooling by ambient air both when idle and particularly when carriage assembly 40 rapidly reciprocates in the x-axis during printing operations.

Figure 6:
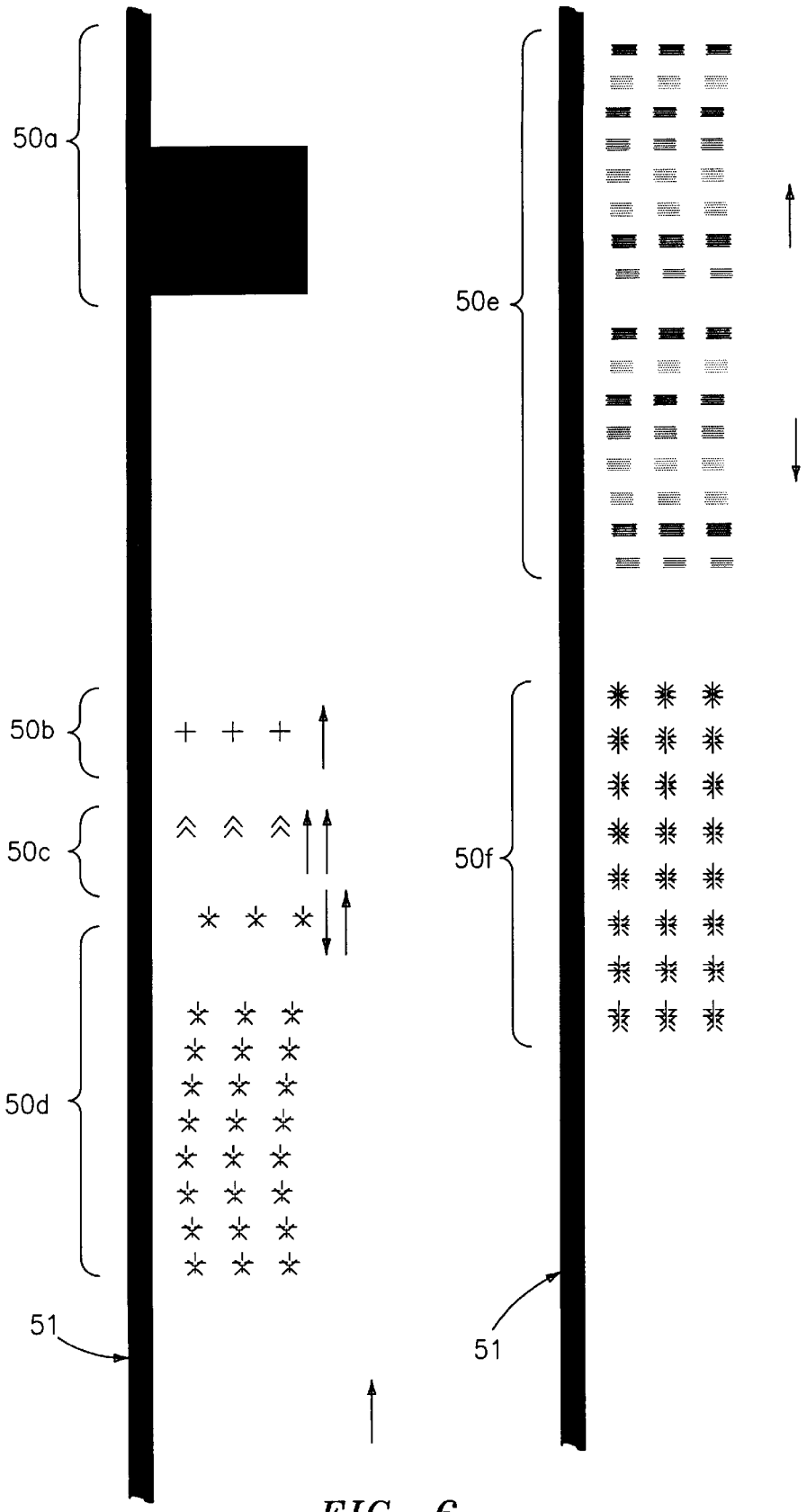
FIG. 6 depicts a representative sample of seven (7) sets of calibration patterns preferably used in conjunction with the method and apparatus of the present invention.

Referring to FIG. 6, illustrating a representative sample of seven (7) sets of calibration patterns preferably used in conjunction with the method and apparatus of the present invention and to iteratively perfect registration of the plurality of printing heads 43. These seven patterns are denoted by reference notation 50*a*–50*f* next to parentheses denoting each said pattern in FIG. 6, and are preferably printed immediately prior to use, although as can be appreciated by one of skill in the art, the seven patterns 50*a*–50*f* may also be printed in a single composite pattern printing operation prior to initiating any of the sensing and registration compensation steps of the present invention (and either immediately inspected, or dried sufficiently and then compensated). In the event that all patterns 50*a*–50*f* are printed at the same time, the sensing, processing, and compensating steps that take place in the preferred form of the invention are simply applied to each said pattern 50*a*–50*f* and thus, the patterns 50*a*–50*f* all share the same positional inaccuracy (instead of the increasing accuracy and precision of the preferred iterative process whereby adjustments are made prior to printing each succeeding pattern of dots).

Figure 13:
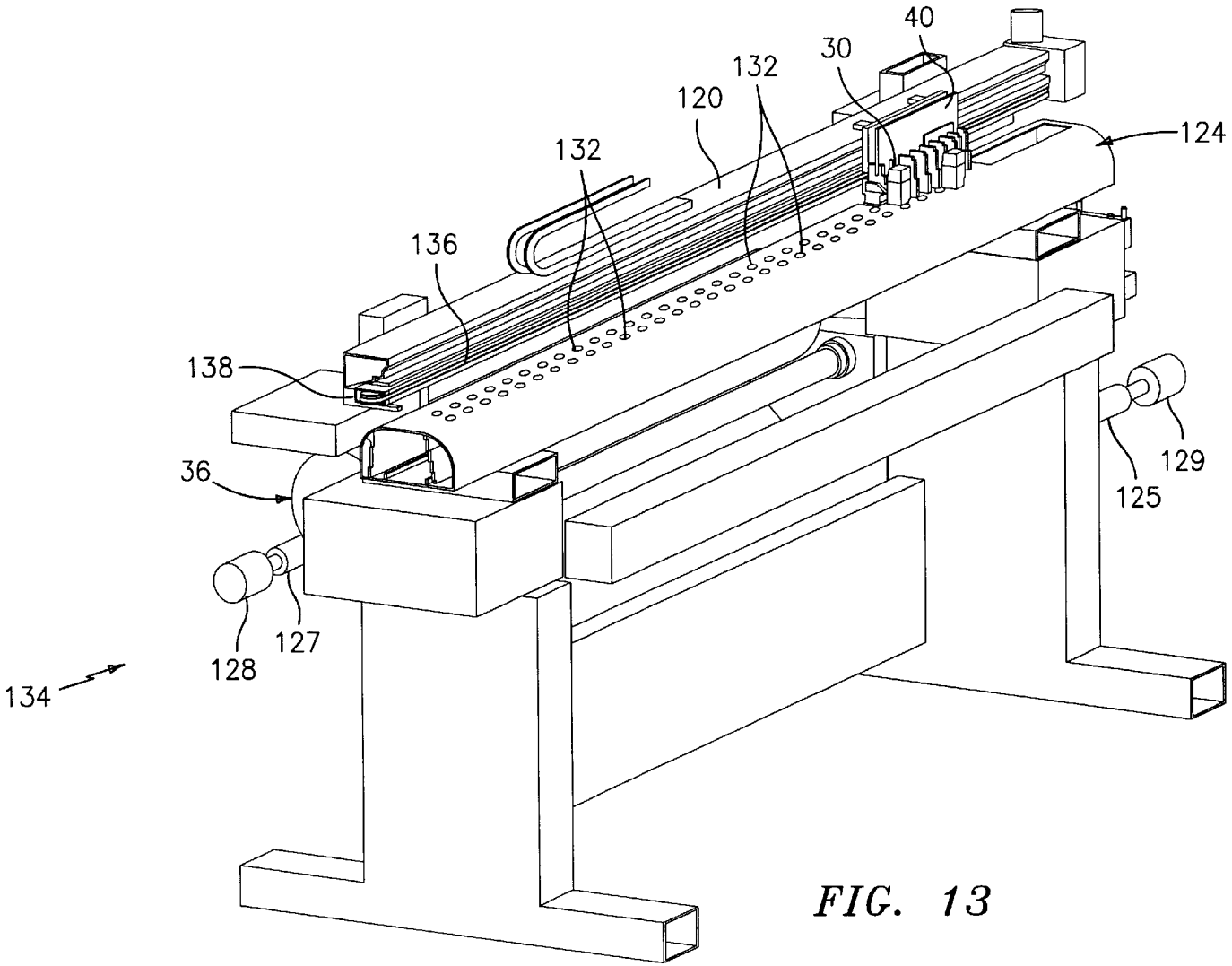

In either event, the present methods require a print engine print media handling capability that includes accurate means of determining carriage location in the x-axis (carriage axis) and y-axis (media web axis). The former is typically adequately provided with a linear encoder for most types of traditional printers and the latter typically involves use of a rotary encoder coupled to a media advance/drive motor means for both carriage-based and drum-based print engines, although a second linear encoder for a flat-bed is preferred. However, in a practical and efficient embodiment, the inventors simply utilize the motor activation signals, and assume that the motor responds accurately to commands for minute radial movement. In practice, however, a certain amount of slippage has been detected so the inventors conclude that addition of an accurate means of exactly determining actual media advance will result in a completely closed loop instantiation of the apparatus and method of the instant invention as can be seen in FIG. 13. For the linear encoder preferred herein, the inventors prefer minute demarcations in a linear encoder 120 of a transparent, fairly rigid, and resinous material retained without tension or compression parallel to a printing platen 124 of a typical carriage-based print engine 134. To accomplish this end, an lateral edge portion the encoder 120 is coated with adhesive material on both sides and a resilient strip of elastic compound applied to form an encoder "sandwich." This encoder sandwich is then adhered to a rigid member spaced from and parallel to platen 124 so that no tension or compression is imparted to the encoder 120. During print operations the carriage assembly 40 is preferably coupled to a resin-based endless drive strap 136 which is in turn driven by a drive spindle 140 coupled to a reversible drive strap motor 138. A portion 41 of the carriage assembly 40 is adapted to optically couple to the encoder 120 to read the minute demarcations and electrically couple to carriage control electronics 30 and thus provide exceptional location accuracy in the x-axis direction.

For determining the location of the carriage assembly 40 (and thus print heads 43 and optical sensor 100) in the y-axis, the paper handling mechanism must prevent or account for media slippage and must be generally extremely accurate in forward and reverse drive and second, overall the amount of forward and reverse movement of the print media 36 must be exactly ascertainable. The inventors appreciate that they could utilize a media drive motor that incorporates a rotary encoder coupled to its drive shaft and that thereby provides an output readily applied for determining the amount of advance of the print media 36 and when used in conjunction with encoder 120, allows an ultimate, accurate determination of the location of the carriage assembly 40 with respect to print media 36. However, in an efficient implementation, the inventors simply utilize the drive signal sent to the media drive motor 129 coupled to take-up spool 125 that receives the print media 36 after the media 36 traverses a preferably vented, vacuum-source driven platen 124 during printing operations. Although this drive signal does not account or compensate for slippage of media 36, for most applications, the drive signal to motor 129 adds negligible error. When a highly accurate y-axis signal is obtained directly from the media 36, or from either or both the radial position of supply spool 127 or take-up spool 125, the present invention will be capable of fully closed-loop control procedures as will be appreciated by those skilled in the art. To allow for accurate reverse operation, a low torque axial motor 128 coupled to the supply spool 127 of media 36 constantly urges media 36 to return to said supply spool 125 and thereby reduces media slippage, increases uniform media contact across vented vacuum platen 124, and helps reduce unwanted "walking" of media 36 back and forth across the platen 124 and the take-up spool 125. To further reduce such unwanted walking, additional apertures 132 are formed in the platen 124 along edges of various width media used for printing operations in print engine 134. As can be appreciated, the optical sensor 100 utilizes these x-axis and y-axis location signals to determine precise location of the cartridges 43 with respect to print media 36.

In FIG. 6, the direction of travel of carriage assembly 40 is depicted by un-numbered arrows above the pattern to which the arrows correspond so that the reader can better apprehend the manner of printing and thereafter sensing said patterns 50*a*–50*f*.

The first pattern to be subject to interrogation by the optical sensor 100 is pattern 50*a* of FIG. 6 which consists of two relatively large printed target areas, a first area printed at full converge with black, or other darkest available colorant, and a second reference area that typically remains unprinted. The first and second areas define the blackpoint and the whitepoint, respectively, used for initial calibration of the optical sensor 100. After pattern 50*a* has been printed the media advance mechanism is reversed so that the optical sensor 100 opposes the general location of the first the whitepoint and then the sensor 100 scans to sense the whitepoint and blackpoint areas with a satisfactory signal magnitude/strength and then said sensor 100 stores said whitepoint and blackpoint signal magnitude values, and location of said areas, for later reference. For the initial pattern 50*a*, any adjacent areas of black and white that can be adequately acquired and the signals compared to confirm operational range of sensor 100 will suffice, although the inventors favor the relatively large, dedicated, initial patterns denoted 50*a*.

The second pattern to be subject to interrogation by the optical sensor 100 is a pattern denoted 50*b* of FIG. 6, which is a sensor homing pattern, and which is preferably printed in a single direction of travel of carriage assembly 40, must be detected by the optical sensor 100. In order to locate the homing mark pattern 50*b*, the carriage assembly is articulated to the coordinates where the horning mark pattern 50*b* was printed. If no successful correlation occurs within a predefined time limit, the sensor 100 enters a scan mode, whereby the sensor 100 begins from the bottom (of the set of three sets of patterns 50*a*–50*f*) and scans back and forth as the media rewinds until the pattern 50*a* is acquired. The term "acquired" is intended to apply most readily to a condition whereby an output signal from sensor 100 spikes to near the top of its signal range when a reference bitmap pattern compares favorably with the then-present sensor-acquired bitmap image from sample and hold circuit 110. These scanning procedures can be implemented in both the x-axis and y-axis directions until satisfactory correlation of said homing mark pattern 50*b* has been accomplished by successful comparison (and positive correlation) to a reference bitmap image of a reference homing mark created from the same specification used to print the homing mark pattern 50*b* upon the media 36.

The third pattern to be subject to interrogation by the optical sensor 100 is a pattern denoted 50*c* if FIG. 6, which is termed a "scaling pattern." Scaling pattern 50*c* is preferably printed in a single direction of travel of carriage assembly 40 over print media 36 and consists of two identically shaped dot patterns, each printed with the same set(s) of ink emitting nozzles 46 and having a pre-selected precise separation distance between the two identically shaped dot scaling patterns 50*c*. When the optical sensor 100 correlates to pattern 50*c* by positive comparison to an image reference bitmap of said pattern 50*c* (as produced by commonly specified data), an immediate correlation of separation, or height, of the ink emitting elements and print media 36 becomes available. A scaling factor is generated as a result of this step of the registration procedure where the number of pixels present in the optical sensor can be accurately related to an expected, or typical-sized dots recorded to create a first of two identical sets of dot pattern upon printing media 36, each having the pre-selected separation from the other set of identical dot patterns. For example, a first dot pattern sensed by the optical sensor 100 may produce an appreciable signal from the optical sensor 100 due to the presence of a number of discrete dots of colorant on the printing media 36 that measures approximately six or seven imaging pixels of the sensor 100 in diameter as seem in FIG. 11. After ascertaining this information, the height of the ink emitting nozzles can be accurately calculated and the diameter of the average dot of colorant on the print media 36 can be determined and stored for later comparison or correlation to measure dot gain and other changes in the appearance or dimension of said dots, and thereafter used to account for such changes to affect color transforms used to print color images.

Once the scaling factor has been obtained, a testing of each ink emitting nozzle of each print head is conducted, as illustrated by pattern 50*e*. This pattern 50*e* is denoted the "fingerprint" pattern because every ink emitting nozzle receives an excitation sequence to emit ink over a relatively tiny portion of the print media 36. This pattern 50*e* was selected to provide optimum results regarding non-firing, mis-firing, and mis-directed ink emitting nozzles. The pattern 50*e* comprises a single discrete dot of colorant for each nozzle separated adequately to provide a relative noiseless, or clean, bitmap signal from the optical sensor 100. A variety of similar patterns 50*e* are therefore easily determined and rendered and are implicitly covered hereby. Since each print head 43 should typically possess performance characteristics identical in all respects to all other print heads 43 (except for color) the sensed bitmap of image data regarding the dots of colorant can be compared to known, acceptable standards for dot placement from a fault-free stationary print head. To the extent that one or more dots fails to appear or is too small to be adequately sensed by optical sensor 100 the corresponding ink emitting nozzle is turned off, and a replacement ink emitting nozzle mapped to provide coverage in lieu of the original print head nozzle. If a dot from a particular nozzle appears to be driven at a greater velocity than others from the print head 43 it will be tagged as a reference nozzle and all others are typically slaved to such a reference nozzle in order to compensate for discrete ink droplet velocity inconsistencies due primarily to manufacturer imperfection in physical and electrical properties of said print head 43. The address of each defective nozzle is stored and will be discarded if feasible, given a then-present magnitude of other, less serious nozzle defects.

Next, a pattern 50*d* useful for detecting the common, repeatable positional error(s) due simply to bi-directional scanning of the carriage assembly 40 during printing operations is applied to the print media 36. These common errors arise primarily as a result of the velocity imparted to the ink droplets due to motion of carriage assembly 40, which has a tendency to aggravate even minor ink droplet velocity variation among nozzles of a given print head 43. In the present invention these errors are identified by the magnitude of positional error, or separation, between each of at least two ink droplets printed on a bi-directional printing scan during separate passes of the carriage assembly 40. Compensation for such bi-directional dot position errors involves simply modifying the timing of the excitation sequence for said dots so that each records upon the media at a position centered between the location of the two calibration dots. For this pattern 50*d* each ink emitting nozzle of each print head 43 prints complementary patterns on each of two successive passes over the printing media 36 so that the resulting monochromatic pattern reveals timing and dot placement discrepancies between a first pass of carriage assembly 40 and a second pass in the opposite direction. The inventors prefer use of a "plus" sign on one pass and an overlapping cross symbol, or "multiplication" sign, for the second pass, although other suitable patterns will reveal these bi-directional printing errors just as readily. Upon inspection by the optical sensor 100, variation in placement of discrete dots will be revealed, again, in comparison to a reference bitmap synthesized from common source data used to print the pattern 50*d*. To the extent that such variation in placement occurs in the x-axis direction they are correctable by simple temporal adjustment of the excitation sequence for that particular nozzle. To compensate for ink emission velocity variation among several ink emitting nozzles of a given print head, the most advanced, or earliest-arriving, dot is identified for each print head 43 and set as a reference for firing of all other ink emitting nozzles associated with the print head 43. Thus, typically only a slight time delay in firing any other ink emitting nozzle of said print head is needed to correct for the separation among dots due to velocity error. At the completion of this step each of the ink emitting nozzles of each of the print heads 43 operating in the print engine should be in tune with other nozzles of the same print head, but not necessarily with other nozzles of other print heads operating in the print engine.

Thus, the final pattern of a preferred sequence of the present invention is the one identified as pattern 50*f*. Pattern 50*f* was selected to provide a common operating reference point for each of the print heads 43 in this head-to-head calibration pattern. The inventors prefer to utilize the black (K) as the reference point, although other colorant may be selected. Accordingly, a black "cross" (X) mark is applied to the print media 36 for each print head operating in the print engine (including the print head printing the reference colorant). Then, each print head attempts to create a corresponding "plus" (+) having a common center location with the cross mark. Then, each of these composite marks are inspected by optical sensor 100 and any offset recorded in memory and transferred to appropriate control circuitry to influence printing locations of such offset dots. If the offset appears as a y-axis offset, the print head that prints a pattern that lags the other can preferably be compensated by moving all excitation sequences for said lagging print head to an earlier scan line for printing. Pursuant to the teaching of the present invention such a y-axis variation is preferably treated by modifying the scan line in which the nozzle excitation sequence causes colorant to record dots on the media. In practice, the inventors have corrected such a variation occurring in the y-axis direction by a total of 35 pixels. This extreme example was produced in an effort to adequately compensate for an extremely warped carriage assembly, similar to the carriage assembly depicted in FIG. 2 herein. To the extent that a greater variation occurs in the y-axis direction (and was not earlier detected and corrected or eliminated in the during the fingerprint pattern) the inventors recommend that the offending cartridge simply be reseated if possible prior to further operation and/or an appropriate reserve cartridge be identified and mapped to emit ink in lieu of the mis-firing, or non-firing, ink emitting nozzles of the first cartridge during subsequent printing operations.

Figure 7:
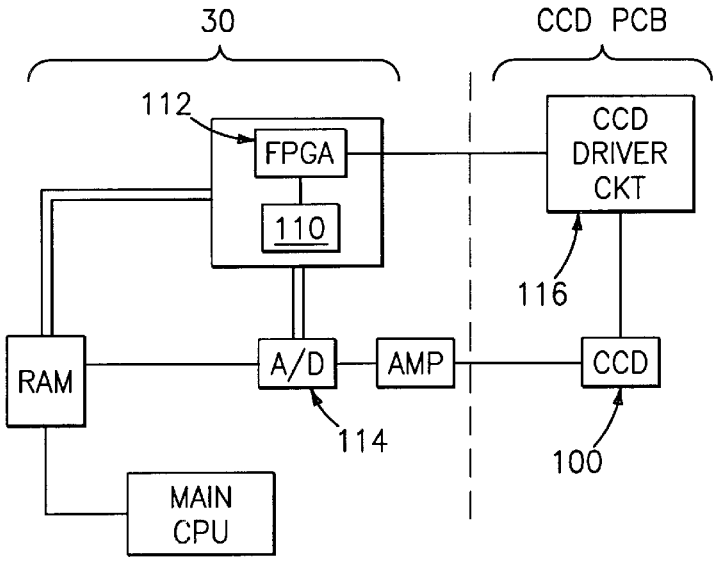
FIG. 7 is functional flow diagram depicting the major operations of a preferred embodiment of the present invention.

FIG. 7 is functional flow diagram depicting the major operations of a preferred embodiment of the present invention. The optical sensor 100 is electrically coupled to an appropriate driver 116 for the optical sensor 100, which in turn is electrically coupled to a sample and hold circuit (preferably designed for CCD imagers) 110, which in turn is coupled to a field programmable gate array (FPGA) 112, and analog to digital (A/D) converter 114, all of which are commercially available and use existing electronic circuitry which thereby increases the likelihood of obtaining successful results without undue experimentation. To this end, the inventors identify these representative circuit elements for use in a preferred embodiment of the present invention. The sample and hold circuit for CCD imagers 110 is supplied by Texas Instruments Incorporated of Dallas, Tex., U.S.A., as TI part number TL1591 which is a monolithic integrated sample and hold circuit using BiFET process with Schottky-barrier diodes and designed for use with CCD are imagers. A very fast input buffer amplifier, a digital-controlled diode-bridge switch, and a high-impedance output buffer amplifier are incorporated into a conventional dual-in-line package having eight pins. The electronic switch is controlled by an LS-TT1-compatible logic input. The driver circuit 116 selected for use with the optical sensor 100 of the preferred embodiment also is supplied by Texas Instruments Incorporated as part number TMC57253. This driver circuit 116 is a monolithic CMOS integrated circuit designed to drive image-area gates, antiblooming gate, storage area gate and serial register gate of the sensor 100 (TI Part No. TC255 CCD image sensor).

Figure 8:
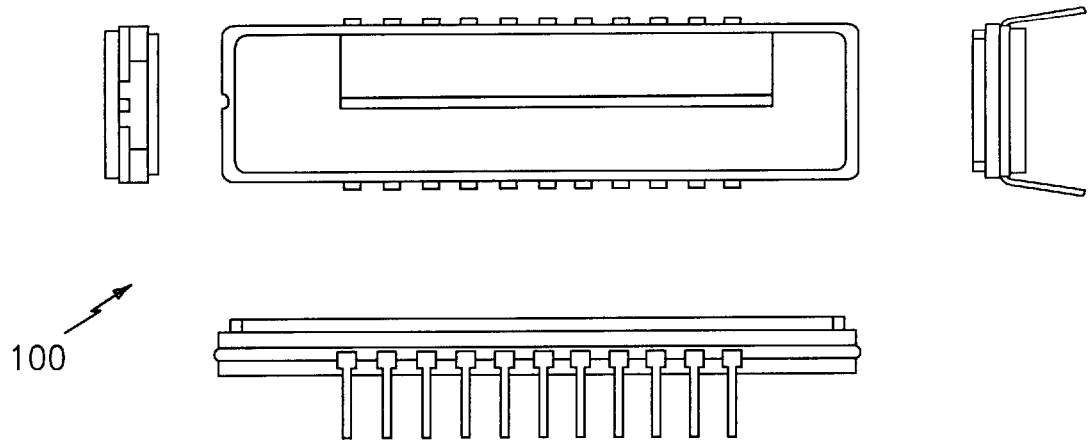
FIG. 8 is a series of three packaging diagrams of a suitable linear CCD array package useful in one embodiment of the present invention.
Figure 9:
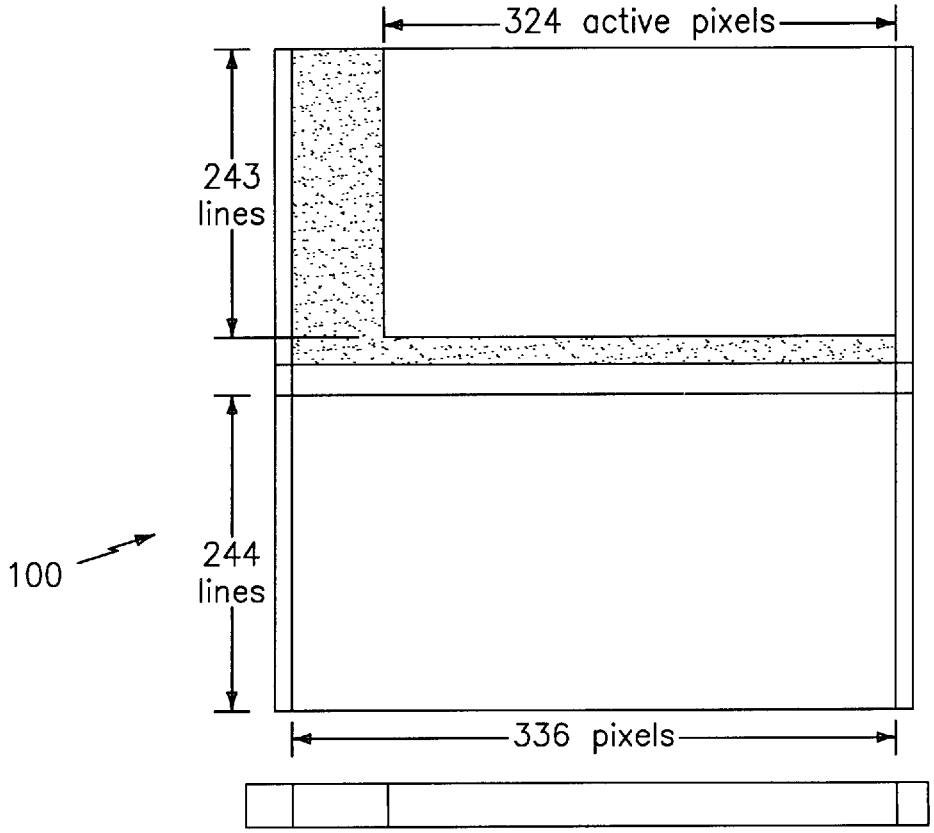
FIG. 9 is a series of three packaging diagrams of a suitable two dimensional CCD array package useful in one embodiment of the present invention

In FIG. 8 and FIG. 9, two commercially available articles suitable for use as the sensor 100 in accord with the teaching of the present invention are depicted. The only material difference between the two arrays is that one is linear array and the other a two dimensional array. In choosing a sensor 100 for color printing operations, it is important to ascertain the sensitivity of the sensor in the desired colors of the visual spectrum. In this respect, the inventors believe that an appropriate sensor 100 must operate rapidly and efficiently with limited illumination, and have sufficient response in the blue region of the visual spectrum in order to operate effectively in conjunction with the present invention.

Referring now to FIG. 8, a suitable linear (single dimensional array) optical sensor 100 is depicted in three views. The particular sensor 100 depicted in FIG. 8 is preferred by the inventors for use in conjunction with the present invention and is supplied by Sony Corporation, of Japan, under part number ILX503A, which is a reduction type charge-coupled device (CCD) linear sensor originally intended for facsimile, image scanner, and OCR use. This sensor 100 contains 2048 sensing pixels in a light weight and relatively low cost package. Extensive additional detailed technical information regarding sensor 100 is available from the supplier, and other similar sensors, such as part number ILX505A 2592 pixel CCD linear Image Sensor also supplied by the Sony Corporation, should operate satisfactorily in conjunction with the present invention. Note that when using a linear sensing array in conjunction with the instant invention, a scanning procedure must instituted in order to generate the two dimensional sensed bitmap image of the dot patterns rendered upon the print media 36.

Referring now to FIG. 9, a suitable two dimensional array optical sensor 100 appropriate for use in conjunction with the present invention is depicted in three views. The package for this sensor array 100 consists of a plastic base 102, a glass window 104, and eight conductor frame 106. The glass window 104 is sealed to the package by an epoxy adhesive and the eight conductors are configured in a standard dual in-line configuration and each conductor fits into a corresponding mounting aperture having 0.1 inch center-to-center spacing. The particular sensor 100 depicted in FIG. 9 and preferred by the inventors is supplied by Texas Instruments Incorporated, of Dallas, Tex., USA under part number TC255P frame-transfer charge-coupled device (CCD). Extensive detailed technical information regarding sensor 100 is available from the supplier and the inventors believe that other suitable sensors should operate satisfactorily in conjunction with the present invention. However, the following information is intended to inform the reader regarding representative details regarding sensor 100. In its two dimensional array embodiment, sensor 100 preferably contains 243 active sensing lines of 336 active sensing pixel elements each (with each pixel ten microns square) in a four millimeter (diagonal) image sensing area and was designed for use in black and white television and special purpose applications, such as taught by the present invention herein, where low costs and small size are desired. Twelve pixels are provided in each line for dark reference. One valuable performance aspect of the sensor 100 is its high-speed image transfer capability. A charge is converted into signal voltage with a twelve microvolt per electron conversion factor by a high-performance charge-detection structure with built-in automatic reset and a voltage reference generator. The signal is buffered by a low-noise two-stage source-follower amplifier to provide high output drive capability. The sensor 100 is manufactured using a proprietary virtual-phase technology, which provides the sensor 100 with high response in the region of the visual spectrum perceived as the color blue—an important feature for use in conjunction with the present invention. In operation, following exposure to incident radiation, image area charge packets are transferred through an image clear line to a temporary memory storage area. The stored charge is then transferred line by line into a serial register for readout. A buffer amplifier converts detected charge into a video signal. As charge is transferred into a pixel detection node the electrical potential of said node changes in proportion to the amount of signal received. The change is sensed by an MOS transistor and (after proper buffering) the signal is supplied to an output terminal of the image sensor. After the change in electrical potential is sensed, the node is reset to a reference voltage supplied by an on-chip reference voltage generator. This reset is accomplished by a reset gate that is connected internally to a serial register. The detection node and the buffer amplifier are located a short distance from the edges of the storage area; therefore, two dummy pixels are used to span the short distance. The output signal of the sensor 100 is 60 mV (+/−10 mV).

Figure 10:
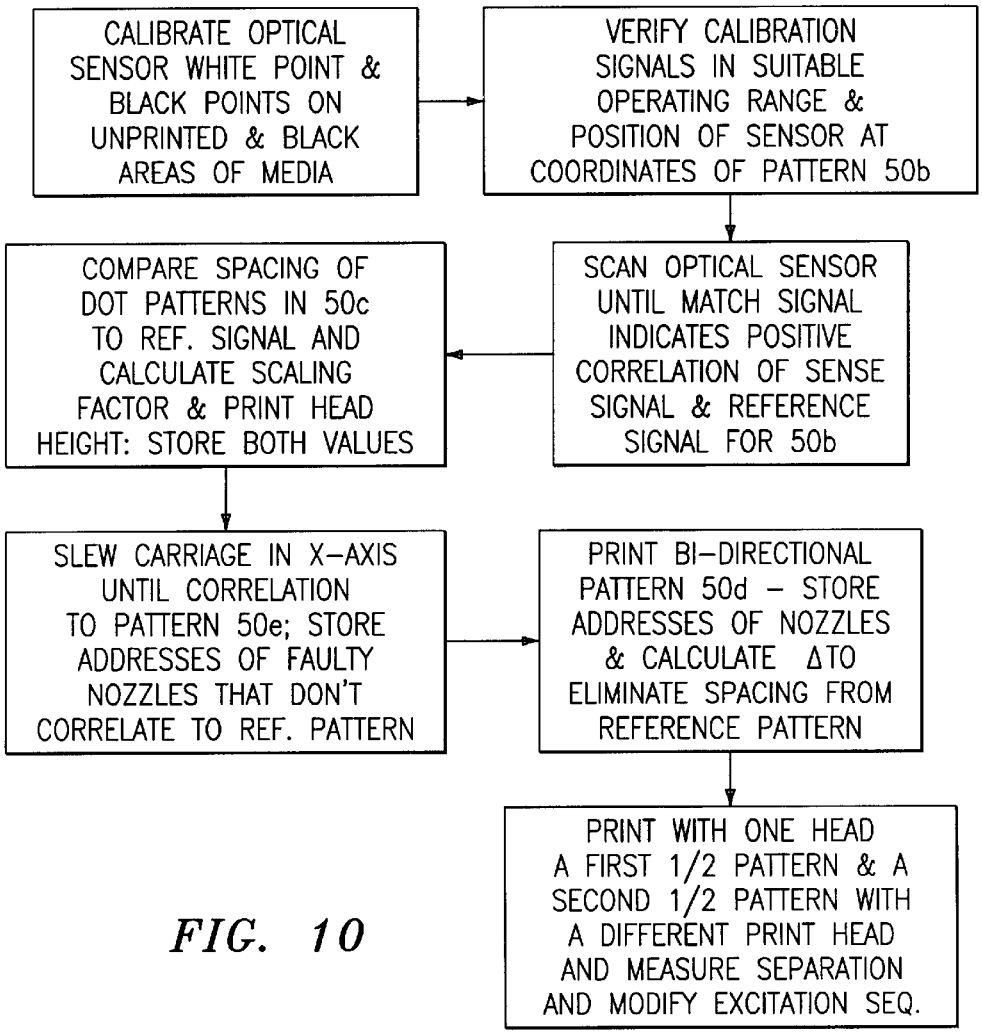
FIG. 10 is a flow chart depicting a preferred sequence for conducting the seven (7) sets of calibration patterns pursuant to the present invention.

In FIG. 10, a flow chart depicting the sequence of steps of the present invention are illustrated and needs no further discussion. In each said step (the details of which are more fully explained in the written description herein) a previously printed pattern of dots are sensed (sample and hold process for individual sensor images) by the optical sensor 100 until a positive correlation is made between the sensed image pattern of dots and a bitmap reference pattern of dots. When a positive correlation occurs, an output signal from the sensor 100 reaches a maximum value and the separation of the center of said positive correlation is exactly determined and stored in memory for use in adjusting the excitation sequence during later printing operations. Since all dot patterns are relatively located with respect to a fiducial mark, the location of each individual dot recorded upon the media 36 can be ascertained and described in terms of the distance from said fiducial mark. Typically, a variation in dot location along the x-axis direction is compensated with a change to the timing of the excitation pulse used for creating the dot. If a y-axis variation is detected in a pattern such as the fingerprint pattern 50*e*, the corresponding nozzle is deemed faulty and eliminated from further operation. However, if a y-axis variation is indicated for an entire pattern of dots that are otherwise emitting ink droplets and creating satisfactory recorded dots, as in head-to-head registration pattern 50*f*, the excitation sequence for the entire pattern is modified to begin printing in a different print swath so that the y-axis variation is eliminated.

Figure 11:
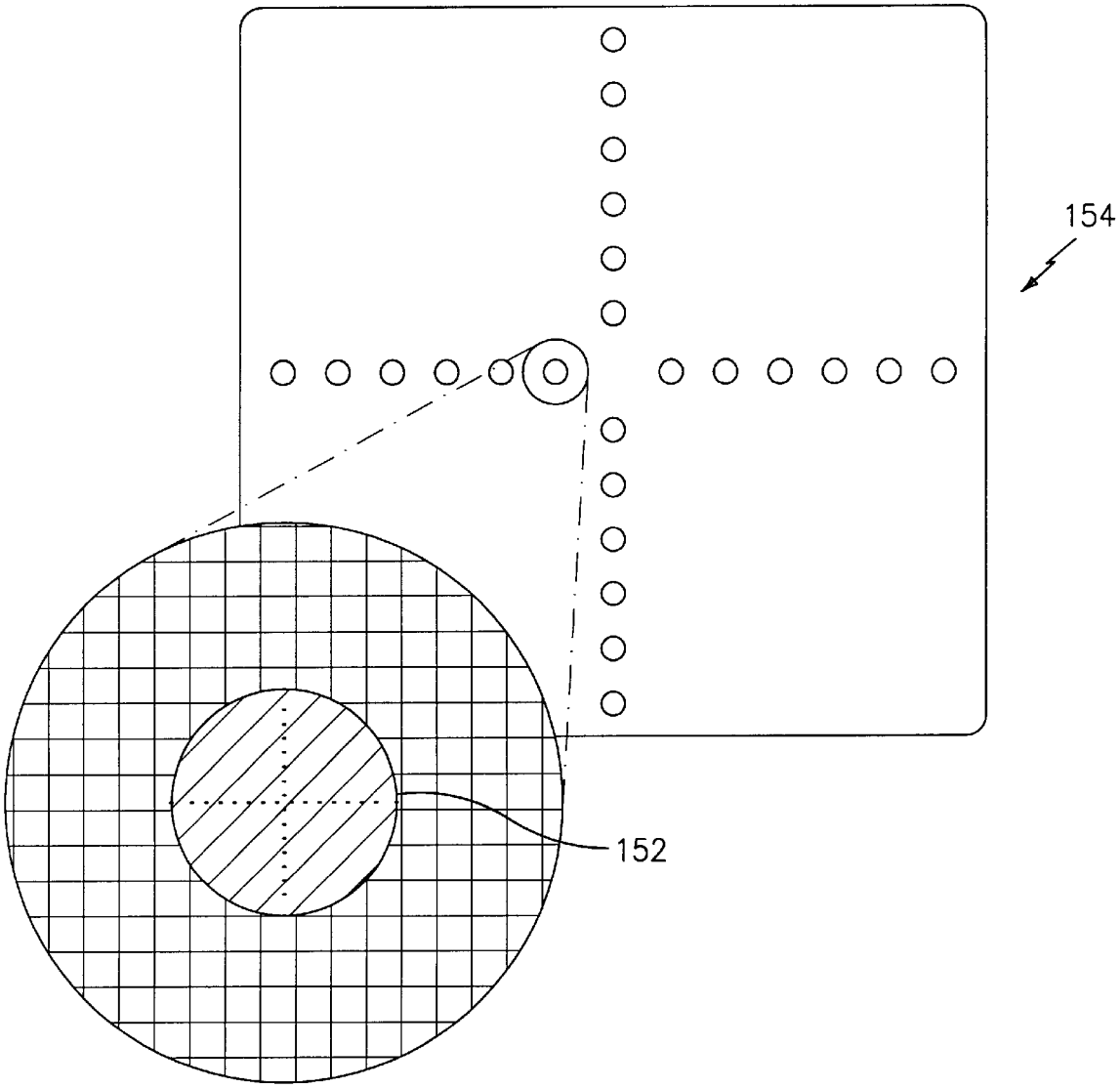
FIG. 11 is a plan view of a bitmap image of a representative pattern sensed with a linear or two dimensional array optical sensor and includes a partial enlarged view of a portion of said media showing a single dot of colorant recorded across several pixels of the optical sensor.

In FIG. 11, a representative bitmap image sensed by sensor 100 is depicted and a portion of said bitmap image is shown enlarged to illustrate an expected resolution of the sensor 100 when viewing individual dots which comprise dot patterns herein. The field of view of sensor 100 is approximately 40 pixels wide by 60 pixels high in a present iteration of the present invention which is adequate for the purposes herein. The inventors recognize, however, that the field of view may be increased arbitrarily by advances in the art as well as needs of certain applications. In one embodiment expressly covered hereby, a sensor 100 having an expanded field of view is fixed to the chassis of the print engine and in conjunction with highly accurate media handling apparatus all the advantages of the teaching of the present invention with respect to traditional swath-type carriage based print engines are realized.

Figure 12:
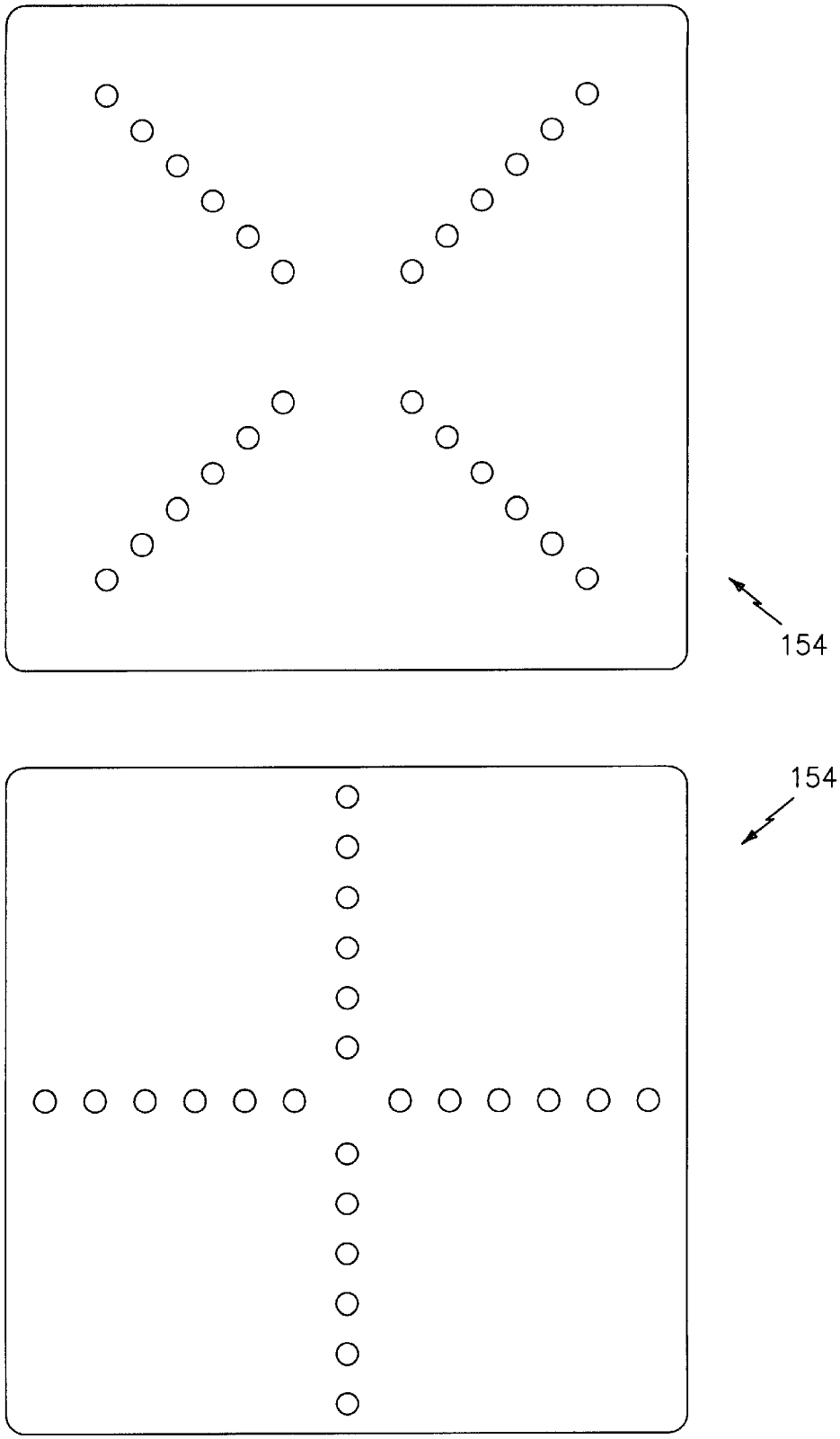
FIG. 12 shows two representative bitmap reference patterns each synthesized from a common specification which common specification is also preferably used to print calibration image patterns on the media.

In FIG. 12, two representative reference patterns 150 are shown that possess appropriate design qualifications for use in improving registration in the bi-directional and head-to-head printing direction. Namely, these two reference patterns 150 share very few common pixel addresses whether or not the two patterns 150 overlap. Thus, the two patterns 150 may be moved and sensed by sensor 100 without appreciable noise from the other of the two patterns. Note that neither of the two patterns 150 have any "center" pixels filled and therefore the likelihood of interference between any reference dot patterns used for both patterns 150 does not occur.

In FIG. 13, which is a perspective view with some parts missing or shown in an exploded view, print engine 134 is shown wherein linear encoder 120 is attached without tension or compression in a sandwich-type fitting in optical communication with a sensor oriented upon carriage assembly 40. The carriage assembly 40 reciprocates in the x-axis direction on slider rails 137 driven by drive strap 136 which winds around spindle 140 which in turn is mechanically coupled to drive strap motor 138. An environmental sensor 122 is disposed in an interior passageway of platen 124 to sense temperature, humidity, acidity, and the like and supply representative signals regarding said environmental conditions to print engine control electronics, which are in turn electrically coupled to carriage drive electronics 30. A plurality of vacuum apertures 132 are disposed across the media bearing surface of platen 124 and the apertures 132 are in turn fluidly coupled to at least one fan 130 which draws air through the apertures 132 which thereby supplies a retaining force to a print media 36 residing thereon. At the periphery of expected various standard widths of media used in the print engine 134, additional apertures 132 are formed to further improve contact of the edges of the media 36 to the platen 124 during printing operations. A second set of passageways fluidly couple print engine electronics to fluid exit ports so that air is drawn into said electronics bay, heated slightly due to interaction with heated circuit elements therein and then passed to fluid exit ports formed so that the slightly heated air exited therefrom creates a veritable curtain of air across the face of media 36 that has just received colorant from print heads 43.

The following examples are presented to aid the reader in appreciating the inventive concepts herein as well as the variation in their application in solving the long-standing difficulties in achieving perfect registration between and among a large number of ink emitting elements associated with non-impact print heads. The following methods and apparatus are merely illustrative and do not constrain the claimed subject matter herein whatsoever, which claimed subject matter shall only be limited by the terms of the appended claims.

EXAMPLE 1

A method of successively improving registration among several non-impact print heads operating in a digital print engine comprising the steps of:

printing a variety of test patterns of a plurality of discrete dots upon a media by sequentially energizing each ink emitting element under electronic control in accordance with a pre-selected reference image map;

sensing the presence of the plurality of dots of each test pattern with an optical sensor that resolves a position of said test pattern, and the position of each said dot of the test pattern until a positive correlation occurs for a majority of dots of said test pattern and the reference image map;

temporarily storing said position of each said dot of said test pattern in a coordinate table;

comparing said position of each said dot stored in the coordinate table to a corresponding dot from said reference image map and storing a unique address for each said dot that does not favorably compare to its corresponding dot from said reference image map; and adjusting an excitation sequence for each dot to correct for positional error of said dot from the expected location of its corresponding dot in said test pattern.

EXAMPLE 2

An improved apparatus for perfecting registration among a plurality of ink emitting nozzles operating in a carriage-based multi-printhead digital print engine under electronic control, wherein the print engine includes a highly repeatable, reversible paper handling subassembly and a carriage-position resolution capability, the improvement comprising:

a) means for sensing, acquiring, and storing bitmap images of discrete dot patterns printed upon a print media;

b) means for comparing said bitmap images of discrete dot patterns with corresponding bitmap reference patterns and storing positional information regarding individual dots that do not positively correlate; and, c) means for adjusting at least one timing variable of an excitation sequence to compensate for each said individual dot that did not positively correlate in step b).

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

What is claimed is:

1. A method of successively improving registration among several non-impact print heads operating in a digital print engine to simultaneously print several different colors on ink comprising the steps of:

a) printing a variety of test patterns of a plurality of discrete dots upon a media by sequentially energizing each of a plurality of ink emitting elements of each one of several non-impact print heads under electronic control in accordance with a pre-selected reference image map;

b) sensing the presence of the plurality of dots of each test pattern with an optical sensor that resolves a position of the position of each said plurality of dots of the test pattern until a positive mathematical correlation occurs for a majority of a portion of said plurality of dots of said test pattern compared to the pre-selected reference image map;

c) temporarily storing said position of each said plurality of dots of said test pattern in a coordinate table;

d) comparing said position of each of said plurality of dots stored in the coordinate table to a corresponding dot from said pre-selected reference image map and storing a unique address for each of said plurality of dots that does not mathematically correlate to its corresponding dot from said pre-selected reference image map; and e) adjusting an excitation sequence for each of said plurality of dots to correct for positional error of each said pluralty of dots from the expected location of the corresponding dot in said test patter.

2. The method of claim 1, wherein the test pattern is generated from a common test pattern template also used to generate the pre-selected reference image map and the sensing step is accomplished with a pixel-level sensing device which further comprises a charge-coupled device.

3. The method of claim 1, wherein the pre-selected source of illumination comprises a variable source of illumination alternating between at least four pre-selected wavelengths of illumiating radiation in the visible spectrum, wherein said variable source of illumination is at least four light emitting devices.

4. A method of improving registration among a plurality of ink emitting nozzles residing upon different inkjet print heads, the method comprising the steps of:

emitting at least X individual droplets of a marking material upon a printing substrate under a known excitation control sequence to a plurality of ink-emitting nozzles of a first print cartridge;

sensing a location and a chromatic identifier information set for each of at least a number Y of the X individual droplets with an optical sensor, wherein X>Y;

storing said sensed location and chromatic identifier information set; and applying a compensation control sequence to the first print cartridge based upon the stored location and chromatic identifier information set that is different from the known excitation control sequence to improve the positional accuracy of said individual droplets with respect to said known excitation control sequence.

5. An improved apparatus for perfecting registration among a plurality of ink emitting nozzles operating in a carriage-based multi-printhead digital print engine under electronic control, wherein the print engine includes a highly repeatable, reversible paper handling subassenbly and a carriage-position resolution capability, the improvement comprising:

a) means for sensing, acquiring, and storing bitmap images on a pixel-by-pixel basis, of discrete dot patterns printed upon a print media from a plurality of ink emitting nozzles of a thermal inkjet print head;

b) means for comparing said stored bitmap images of discrete dot patterns with a corresponding bitmap reference patterns and storing positional information for each individual dot that does not positively mathematically correlate between the stored bitmap images of discrete dot patterns and the corresponding bitmap reference pattern; and, c) means for adjusting at least one timing variable of an excitation sequence which causes the plurality of ink emitting nozzles of the thermal ink jet print head to compensate for each said individual dot that did not positively mathematically correlate in step b) so that each said individual dot accurately prints on the print media in registration with and among each other of the plurality of ink emitting nozzles of the thermal ink jet print head.

6. The improvement of claim 5, wherein the means for storing bitmap images of discrete dot patterns further comprises a means for eliminating a portion of a relevant excitation sequence for each said discrete dot that fails to meet a threshold criteria of said means for acquiring storing bitmap images of discrete dot patterns printed upon a print media by a thermal ink jet print head.

7. The improvement of claim 6, wherein steps a) through c) are repeated for each of a series of at least three different test patterns and at least one of said at least three different test patterns is printed in a single axial pass of a carriage assembly that retains the thermal ink jet print heads and at least a one other of said test patterns is printed in a series of at least two axial passes in opposing direction and wherein a first of said at least three different test patterns comprises a scaling pattern for determining the spacing of the thermal ink jet print heads a second of said at least three different test patterns comprises a bi-directional test pattern designed to amplify any bi-directional positional errors, and a third of said at least three test patterns comprises a fingerprint-type pattern, that does not contain line segnents, and which indicates whether a nozzle of the thermal ink jet print heads is operational.

8. The improvement of claim 7 further comprising a source of illumination comprising at least eight different wavelengths of light energy that is periodically energized to promote the sensing and acquiring of step a).

9. The improvement of claim 8 wherein the source of illumination is comprised of a plurality of light emitting diodes each selected to improve an optical sensor reading from a select colorant and each of said light emitting diodes covers a discrete portion of the visual radiation spectrum.

* * * * *